US007395758B2

(12) United States Patent
Kusaka

(10) Patent No.: US 7,395,758 B2
(45) Date of Patent: Jul. 8, 2008

(54) INK FOUNTAIN DEVICE WITH ADJUSTABLE INK DAMS AND ADJUSTABLE FOUNTAIN ROLLER

(75) Inventor: Akehiro Kusaka, Tokyo (JP)

(73) Assignee: Komori Corporation, Tokyo (JP)

( * ) Notice: Subject to any disclaimer, the term of this patent is extended or adjusted under 35 U.S.C. 154(b) by 284 days.

(21) Appl. No.: 11/413,560

(22) Filed: Apr. 28, 2006

(65) Prior Publication Data

US 2006/0260486 A1 Nov. 23, 2006

(30) Foreign Application Priority Data

May 19, 2005 (JP) ..... 2005-146442

(51) Int. Cl.
*B41F 31/00* (2006.01)

(52) U.S. Cl. ..... 101/350.1; 101/352.07; 101/352.09; 101/367

(58) Field of Classification Search ..... None
See application file for complete search history.

(56) References Cited

U.S. PATENT DOCUMENTS 3,760,723 A * 9/1973 Taig ..... 101/352.09
3,910,186 A 10/1975 D'Amato et al.
4,729,312 A * 3/1988 Rodi et al. ..... 101/350.1
5,062,359 A 11/1991 Giori
2002/0011163 A1 1/2002 Fina
2005/0028693 A1 2/2005 Aoki

FOREIGN PATENT DOCUMENTS

DE 93 16 916 1/1994
EP 1 504 898 2/2005
JP 03-207653 9/1991

* cited by examiner

*Primary Examiner*—Jill E. Culler
(74) *Attorney, Agent, or Firm*—Blakely, Sokoloff, Taylor & Zafman LLP

(57) ABSTRACT

An ink fountain device includes a fountain roller, a blade, a pair of ink dams, a compression coil spring, and a fountain roller moving device. The fountain roller is rotatably supported by an eccentric bearing. The blade is arranged close to the fountain roller. The distal end of the blade forms a clearance, with respect to an outer surface of the fountain roller, where ink is to be supplied. The pair of ink dams are arranged to be substantially perpendicular to the blade and oppose each other in an axial direction of the fountain roller, and are supported to be movable toward and away from the outer surface of the fountain roller. The compression coil spring biases the ink dams to move toward the outer surface of the fountain roller. The fountain roller moving device pivots the eccentric bearing so as to move the fountain roller. The pair of ink dams are moved by a biasing force of the compression coil spring in a direction substantially perpendicular to a line that connects an axis of the fountain roller and a pivot center of the eccentric bearing.

11 Claims, 7 Drawing Sheets

INK FOUNTAIN DEVICE WITH ADJUSTABLE INK DAMS AND ADJUSTABLE FOUNTAIN ROLLER

BACKGROUND OF THE INVENTION

The present invention relates to an ink fountain device which supplies ink to a plate cylinder through a fountain roller.

As shown in U.S. Pre-Grant Publication No. 2005/0028693, a conventional ink fountain device comprises a fountain roller rotatably supported between a pair of frames, a blade with a distal end opposing the outer surface of the fountain roller to form a clearance through which ink is supplied to the fountain roller, a plurality of adjustment screws with distal ends abutting against the blade to adjust the clearance between the blade and fountain roller, and a plurality of ink dams which form an ink fountain together with the blade and fountain roller. In the conventional ink fountain device, when the plurality of adjustment screws are operated, the distal end of the blade elastically deforms to move toward or away from the outer surface of the fountain roller. This adjusts the size of the clearance formed between the blade and the outer surface of the fountain roller, to adjust the quantity of ink to be supplied to the fountain roller.

In the conventional ink fountain device, when the rotational speed of the printing press changes, the quantity of ink to be supplied to the fountain roller changes. At the start where the printing press has not reached a predetermined rotational speed yet, the quantity of ink to be supplied to the fountain roller becomes smaller or larger than the regular quantity, and wasted paper is continuously generated until the printing press has reached the predetermined rotational speed. The quantity of ink to be supplied to the fountain roller also changes depending on the type of the ink. When the type of the ink is changed, all the adjustment screws that have already been adjusted must be adjusted again, which takes time.

SUMMARY OF THE INVENTION

It is an object of the present invention to provide an ink fountain device which decreases wasted paper.

It is another object of the present invention to provide an ink fountain device which can shorten the time required for adjustment.

In order to achieve the above objects, according to the present invention, there is provided an ink fountain device comprising a fountain roller which is rotatably supported by an eccentric bearing, a blade which is arranged close to the fountain roller and a distal end of which forms a clearance, with respect to an outer surface of the fountain roller, where ink is to be supplied, a pair of ink dams which are arranged to be substantially perpendicular to the blade and oppose each other in an axial direction of the fountain roller, and are supported to be movable toward and away from the outer surface of the fountain roller, first biasing means for biasing the ink dams to move toward the outer surface of the fountain roller, and fountain roller moving (displacing) means for pivoting the eccentric bearing so as to move the fountain roller, wherein the pair of ink dams are moved by a biasing force of the first biasing means in a direction substantially perpendicular to a line that connects an axis of the fountain roller and a pivot center of the eccentric bearing.

DESCRIPTION OF THE PREFERRED EMBODIMENTS

Figure 1:
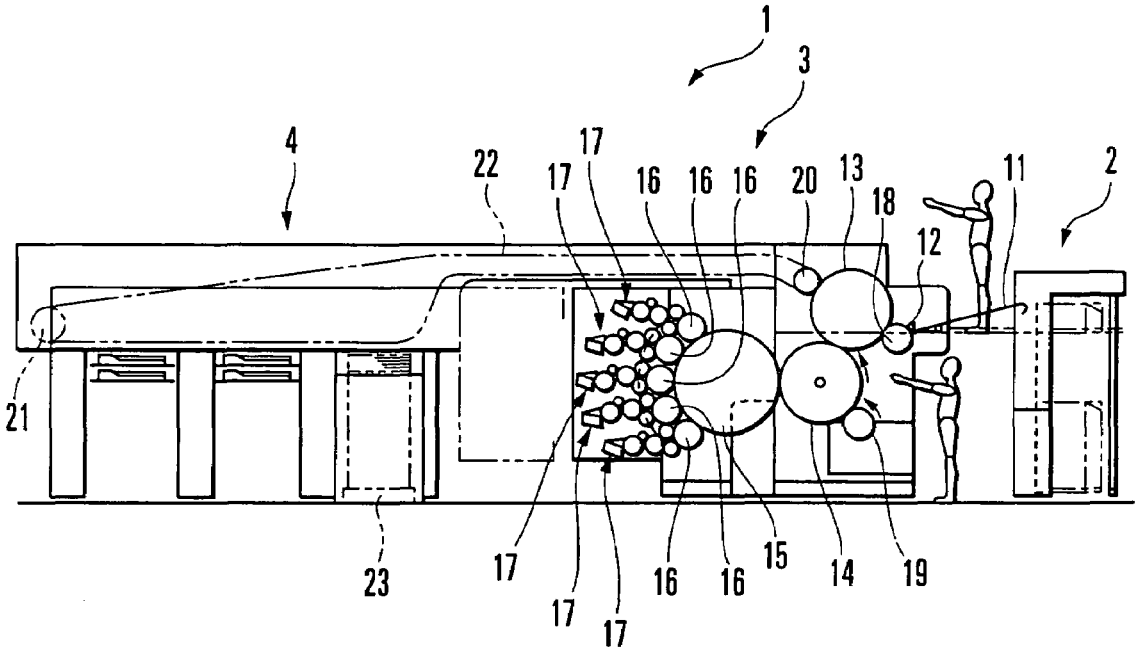
FIG. 1 is a side view showing the schematic arrangement of an intaglio printing press to which an ink fountain device according to the first embodiment of the present invention is applied.

An ink fountain device according to the first embodiment of the present invention will be described with reference to FIGS. 1 to 4. Referring to FIG. 1, an intaglio printing press 1 comprises a feed device 2 which feeds stacked sheets one by one, a printing unit 3 which prints on a sheet fed from the feed device 2, and a delivery device 4 which delivers the sheet printed by the printing unit 3. The sheet fed from the feed device 2 to a feedboard 11 one by one is regulated in the circumferential direction and widthwise direction by a register device, and is then gripped by the grippers of a swing arm shaft pregripper 12.

The printing unit 3 comprises a triple-diameter impression cylinder 13, a triple-diameter plate cylinder 14, a quadruple-diameter ink collecting cylinder 15, a plurality of chablon rollers (partial plate cylinders) 16 each comprising a single cylinder, and a plurality of inking devices 17. The outer surface of the plate cylinder 14 comes into contact with the outer surface of the impression cylinder 13. Three intaglios are mounted on the plate cylinder 14 in a circumferential direction. The outer surface of the ink collecting cylinder 15 comes into contact with the outer surface of the plate cylinder 14. The outer surfaces of the chablon rollers 16 come into contact with the outer surface of the ink collecting cylinder 15. The inking devices 17 supply ink to the corresponding chablon rollers 16. The outer surface of the impression cylinder 13 also comes into contact with the outer surface of a transfer cylinder 18. The transfer cylinder 18 gripping-changes a sheet which has been gripping-changed from the swing arm shaft pregripper 12 to the grippers of the impression cylinder 13. The intaglios mounted on the outer surface of the plate cylinder 14 come into contact with the outer surface of a wiping roller 19. The impression cylinder 13 comes into contact with the outer surface of a delivery cylinder 20. A delivery chain 22 is looped between a sprocket (not shown) coaxially arranged with the delivery cylinder 20 and a sprocket 21 arranged at the rear portion of the delivery device 4.

In the intaglio printing press 1 having the above arrangement, a sheet fed from the feed device 2 onto the feedboard 11 is gripped from the swing arm shaft pregripper 12 by the grippers of the impression cylinder 13 through the transfer cylinder 18. Simultaneously, the ink of the respective inking devices 17 is transferred onto the ink collecting cylinder 15 through the corresponding chablon rollers 16 and supplied onto the surfaces of the intaglios on the plate cylinder 14. At this time, an excessive portion of the ink supplied onto the surfaces of the intaglios on the plate cylinder 14 is removed by the wiping roller 19. The sheet which is to be conveyed as it is gripped by the grippers of the impression cylinder 13 is printed while it passes the opposing point of the impression cylinder 13 and plate cylinder 14. The printed sheet is gripping-changed to the delivery gripper bars of the delivery chain 22, conveyed by the delivery chain 22, and then drops onto a pile board 23 and is stacked there.

The inking devices 17 described above will be described with reference to FIGS. 2 to 4.

Figure 2:
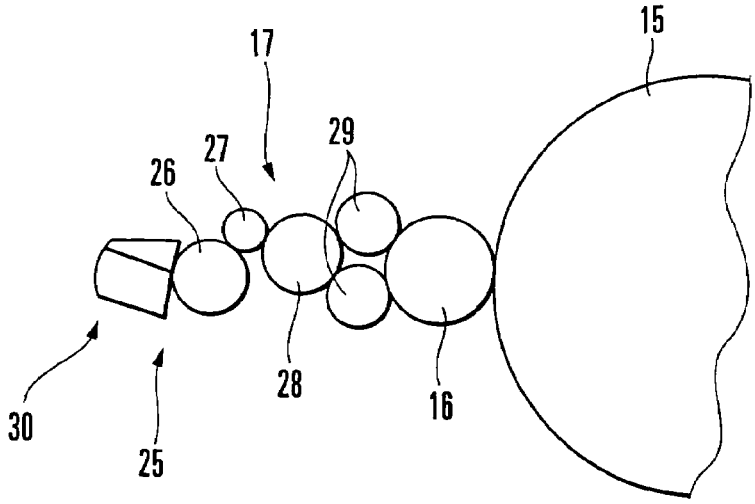
FIG. 2 is a side view showing the cylinder array of an inking device shown in FIG. 1.

As shown in FIG. 2, the inking device 17 comprises an ink fountain device 25, an ink ductor roller 27 (second rotary body in claim 2), an oscillating roller 28 (first rotary body in claim 2), and two form rollers 29. The ink fountain device 25 has a fountain roller 26. The outer surface of the ink ductor roller 27 is in contact with the outer surface of the fountain roller 26. The ink ductor roller 27 is rotatably supported. The outer surface of the oscillating roller 28 is in contact with the outer surface of the ink ductor roller 27. The oscillating roller 28 is supported to be rotatable and movable in an axial direction. The oscillating roller 28 distributes the ink on the fountain roller 26. The outer surfaces of the two form rollers 29 are in contact with the outer surfaces of the oscillating roller 28 and chablon roller 16.

Figure 3:
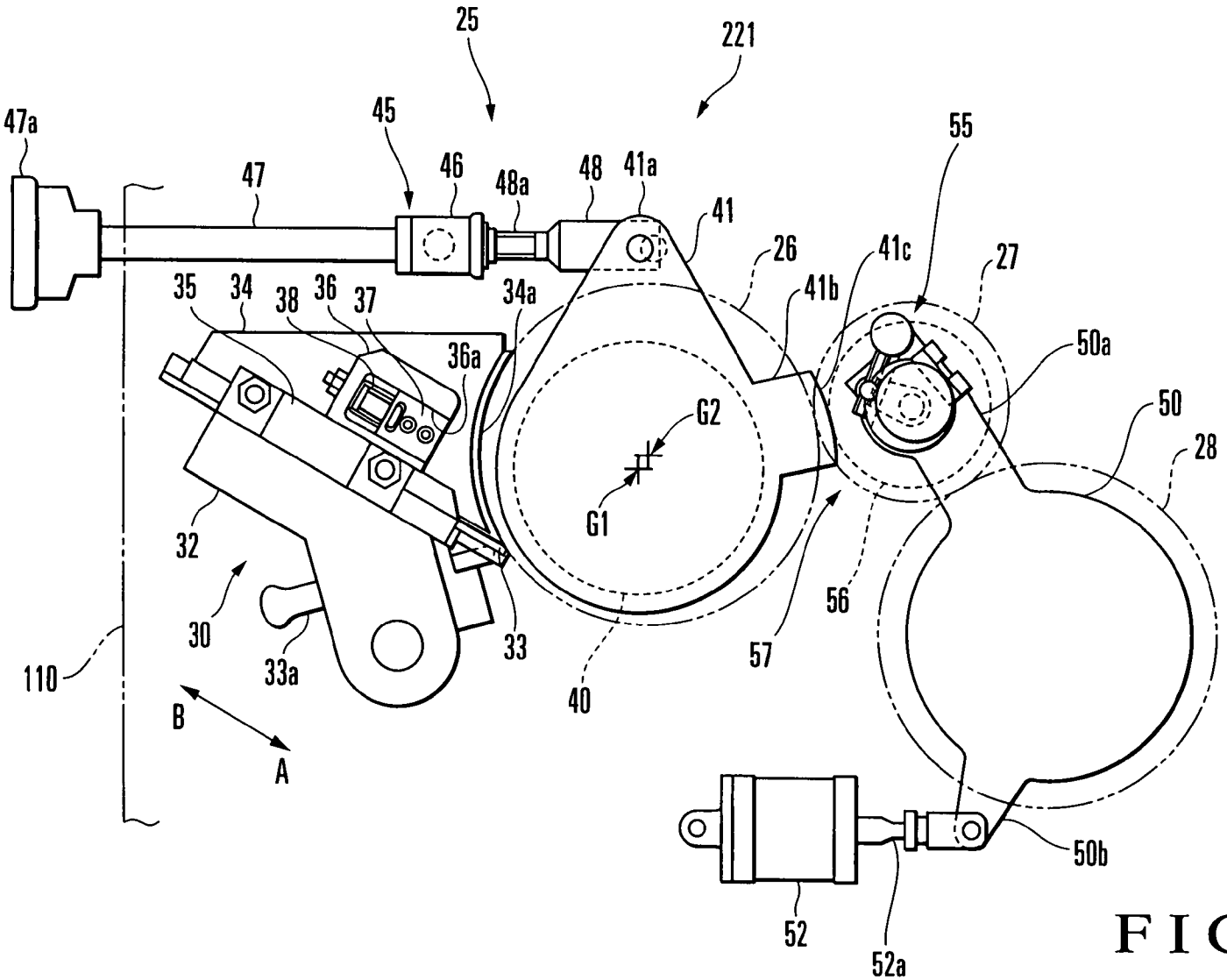
FIG. 3 is a side view showing the main part of the ink fountain device shown in FIG. 2.

As shown in FIG. 3, the ink fountain device 25 comprises an ink fountain 30 which stores the ink, and the rotatably supported fountain roller 26 the outer surface of which forms part of the ink fountain 30. The ink fountain 30 comprises a fountain main body 32, blades 33, and a pair of ink dams 34. The fountain main body 32 is supported close to the fountain roller 26. The blades 33 are cantilevered by the fountain main body 32 and serve as bottom plates. The clearances between the blades 33 and the outer surface of the fountain roller 26 can be adjusted by a plurality of adjustment screws 33*a*. The pair of ink dams 34 are substantially perpendicular to the bottom surface of the fountain main body 32 and oppose each other at a predetermined gap in the widthwise direction (the axial direction of the fountain roller 26) of the bottom surface of the fountain main body 32.

A pair of guide plates 36 (one guide plate is not shown) each having a guide groove 36*a* are attached upright on a pair of support beds 35 (one support bed is not shown) which are attached to the two ends in the widthwise direction of the bottom surface of the fountain main body 32. A moving element 37 which engages in the guide groove 36*a* of the guide plate 36 is attached to the side surface of each ink dam 34. The ink dam 34 is supported by the guide plate 36, which guides the moving element 37, to be movable in directions of arrows A and B (toward and away from the outer surface of the fountain roller 26). A compression coil spring 38 (first biasing means) is elastically mounted between the moving element 37 and guide plate 36. The spring force of the compression coil spring 38 biases the corresponding ink dam 34 in the direction of the arrow A (to move toward the outer surface of the fountain roller 26). Hence, curved front end faces 34*a* of the ink dams 34 are brought into tight contact with the outer surfaces of the two ends of the fountain roller 26.

Figure 4:
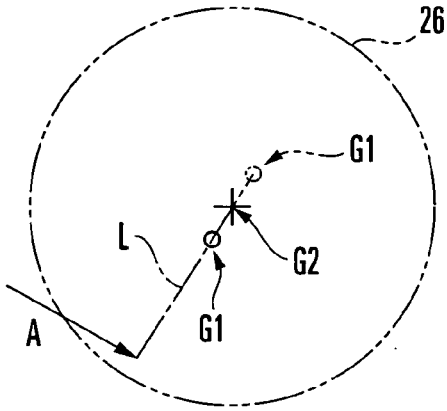
FIG. 4 is a view for explaining the positional relationship between the axis of the fountain roller and the center of an eccentric bearing shown in FIG. 3.

Two eccentric bearings 40 which rotatably support the two end shafts of the fountain roller 26 are pivotally supported by a pair of frames (not shown). At this time, an axis G2 of the fountain roller 26 is eccentric from pivot centers G1 of the eccentric bearings 40. The moving direction (direction of the arrow A) of the ink dam 34 which is moved by the spring force of the compression coil spring 38 is substantially perpendicular to a line L that connects the pivot center G1 of the eccentric bearing 40 and the axis G2 of the fountain roller 26, as shown in FIG. 4.

A flange 41 of the eccentric bearing 40 which is exposed outside the frame has a projection 41*a* projecting from the peripheral portion of the flange 41. A stretchable shaft 48 of a fountain roller moving mechanism 45 (fountain roller moving means) is pivotally mounted on the projection 41*a*. A cam portion 41*b* projects from part of the peripheral portion of the flange 41. The cam portion 41*b* has an arcuate cam surface 41*c* which has the axis G2 of the fountain roller 26 as a center.

The fountain roller moving device 45 comprises a rod-like driving mechanism. The driving mechanism which forms the fountain roller moving device 45 comprises a driving shaft 47 and the stretchable shaft 48. The driving shaft 47 has a handle 47*a* at its one end, and a female screw portion (not shown) at its other end. The stretchable shaft 48 has a screw portion 48*a* at its one end, which threadably engages with the female screw portion of the driving shaft 47. The other end of the driving shaft 47 is connected to the projection 41*a* of the flange portion. The driving shaft 47 is rotatably supported by the frame through a support member 46 such that the movement of the driving shaft 47 in the axial direction is regulated.

A bracket 50 which is pivotally supported to be coaxial with the oscillating roller 28 has an arm 50*a* at part of its peripheral portion, which rotatably supports the ink ductor roller 27 through a nip pressure adjusting device 55. On a side substantially opposite to the arm 50*a*, a projection 50*b* projects from the bracket 50. The rod of an air cylinder 52 (second biasing means in claims) with a cylinder end pivotally supported by the frame is pivotally mounted on the projection 50*b*. The ink ductor roller 27 is biased by the forward biasing force of a rod 52*a* of the air cylinder 52 through the bracket 50 to move toward the fountain roller 26.

The nip pressure adjusting device 55 comprises an adjustment screw which is pivotally supported by the arm 50*a* of the bracket 50, a lever which swings as the adjustment screw moves forward/backward, an eccentric bearing which pivots as the lever swings, and the like. The nip pressure adjusting device 55 adjusts the nip pressure of the ink ductor roller 27 with respect to the fountain roller 26. Such a nip pressure adjusting device 55 is a known device, as disclosed in U.S. Pat. No. 5,062,359.

The ink ductor roller 27 has a cam 56 which is in contact with the cam surface 41*c* of the eccentric bearing 40. The cam surface 41*c* and cam 56 form a first cam device 57. The cam device 57 has the function maintaining a constant nip pressure between the fountain roller 26 and ink ductor roller 27, which has been adjusted by the nip pressure adjusting device 55, even when the eccentric bearing 40 is pivoted by the fountain roller moving device 45.

A method of adjusting the quantity of ink to be supplied from the ink fountain 30 to the fountain roller 26 will be described. First, the nip pressure adjusting device 55 adjusts the nip pressure of the ink ductor roller 27 with respect to the fountain roller 26 to an appropriate value. Subsequently, the plurality of adjustment screws 33*a* are manipulated individually to adjust the clearances between the distal ends of the blades 33 and the outer surface of the fountain roller 26.

At the time of start where the printing press has not reached a predetermined rotational speed yet, the quantity of ink to be supplied from the clearances between the distal ends of the blades 33 and the outer surface of the fountain roller 26 to the fountain roller 26 may become smaller or larger than the regular quantity. Hence, the quantity of wasted paper increases until the printing press has reached the predetermined rotational speed. In order to solve this, if the quantity of ink to be supplied from the clearances between the distal ends of the blades 33 and the outer surface of the fountain roller 26 to the fountain roller 26 is smaller than the regular quantity, the driving shaft 47 of the fountain roller moving device 45 is rotated to pivot the eccentric bearing 40 clockwise in FIG. 3. Then, the axis G2 of the fountain roller 26 pivots clockwise about the pivot center G1 of the eccentric bearing 40 as a center.

As described above, the line L that connects pivot center G1 of the eccentric bearing 40 and the axis G2 of the fountain roller 26 is substantially perpendicular to the direction of the arrow A. When the axis G2 pivots clockwise about the pivot center G1 as the center, the fountain roller 26 moves substantially in the direction of the arrow A. Then, the clearances between the distal ends of all the blades 33 and the outer surface of the fountain roller 26 enlarge by the same amount at once, so that the quantity of ink to be supplied from the clearances between the distal ends of the blades 33 and the outer surface of the fountain roller 26 to the fountain roller 26 is adjusted to become the regular quantity. As a result, wasted paper can be decreased.

This adjustment need not be performed by all the adjustment screws 33*a* separately, but can be performed at once by operating the fountain roller moving device 45. Thus, the adjustment can be performed readily within a short period of time. The moving direction (the direction of the arrow A) of the fountain roller 26 is the same as the moving direction of the ink dam 34 which is moved by the elastic force of the compression coil spring 38. Despite the movement of the fountain roller 26, the entire front end face 34*a* of the ink dam 34 is always in tight constant contact with the outer surface of the fountain roller 26. Thus, ink leakage from the ink fountain 30 can be prevented.

The ink ductor roller 27 in contact with the fountain roller 26 is biased by the biasing force of the air cylinder 52 to move toward the fountain roller 26. When the fountain roller 26 moves, the ink ductor roller 27 follows the fountain roller 27 to move in contact with the fountain roller 26. The cam device 57 is arranged between the fountain roller 26 and ink ductor roller 27. The cam device 57 maintains the nip pressure between the fountain roller 26 and ink ductor roller 27 constant despite the movement of the fountain roller 26. Thus, the nip pressure between the fountain roller 26 and ink ductor roller 27 is adjusted by the nip pressure adjusting device 55 and always maintained constant.

When the quantity of ink to be supplied from the clearances between the distal ends of the blades 33 and the outer surface of the fountain roller 26 increases to be larger than the regular quantity, the driving shaft 47 is rotated to pivot the eccentric bearing 40 counterclockwise in FIG. 3. Then, the quantity of ink to be supplied from the clearances between the distal ends of the blades 33 and the outer surface of the fountain roller 26 to the fountain roller 26 is adjusted to become the regular quantity.

Figure 5:
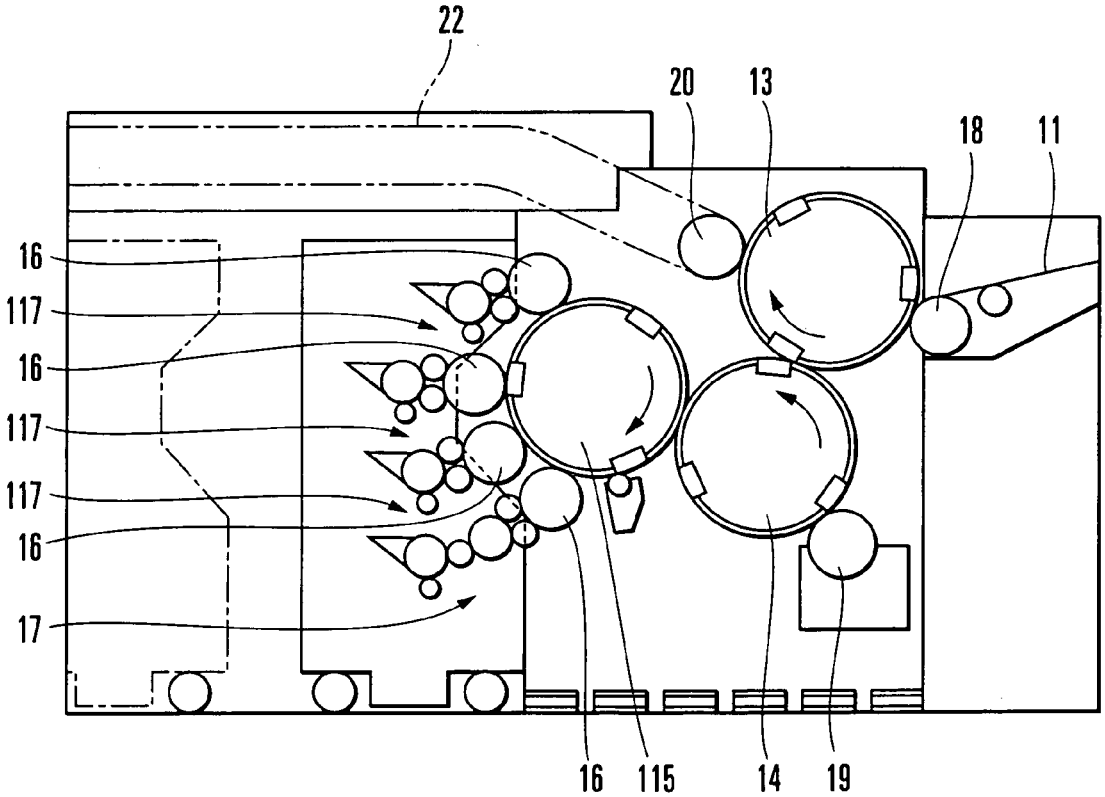
FIG. 5 is a side view showing the schematic arrangement of an intaglio printing press to which an ink fountain device according to the second embodiment of the present invention is applied.
Figure 6:
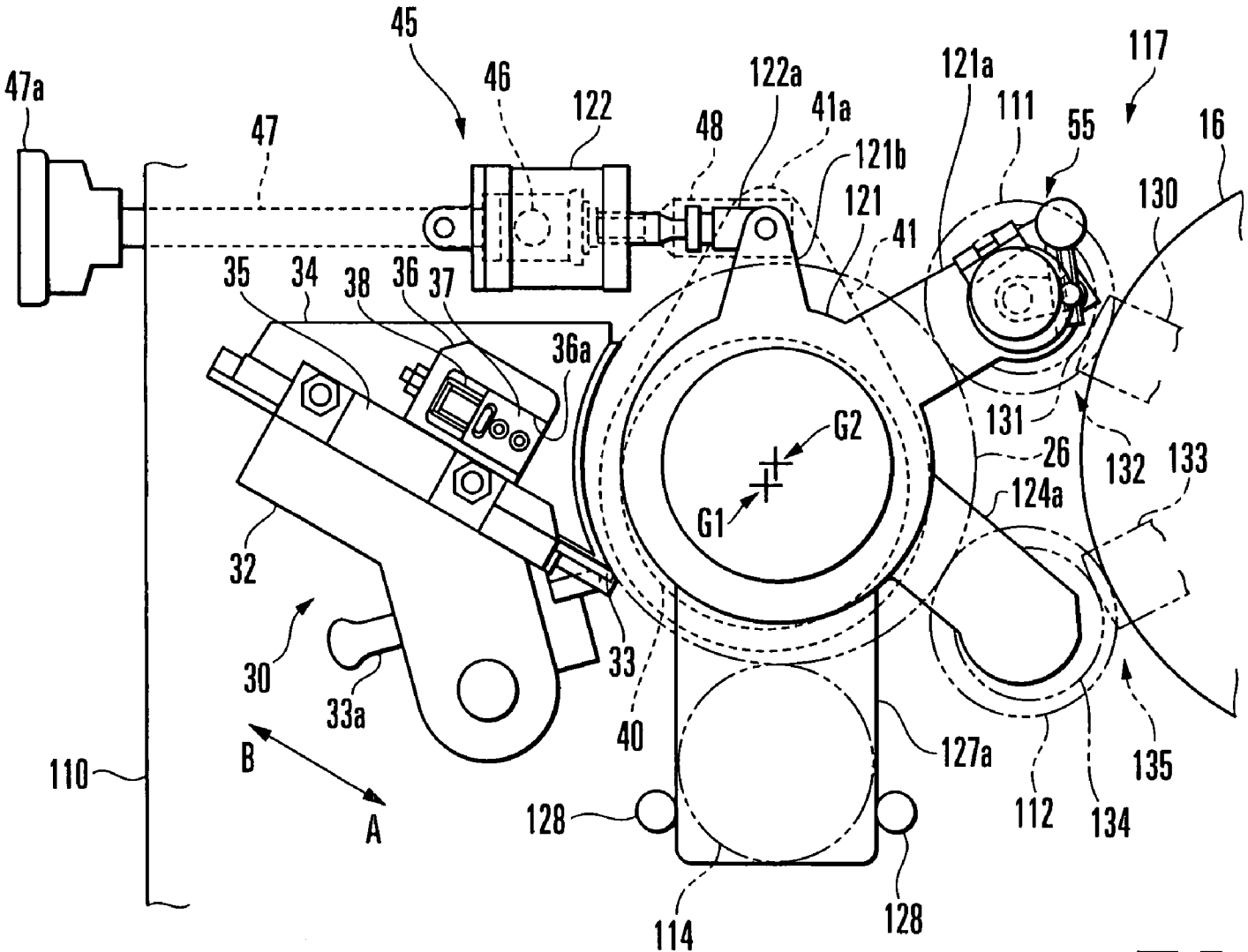
FIG. 6 is a side view showing the main part of the ink fountain device shown in FIG. 5.
Figure 7:
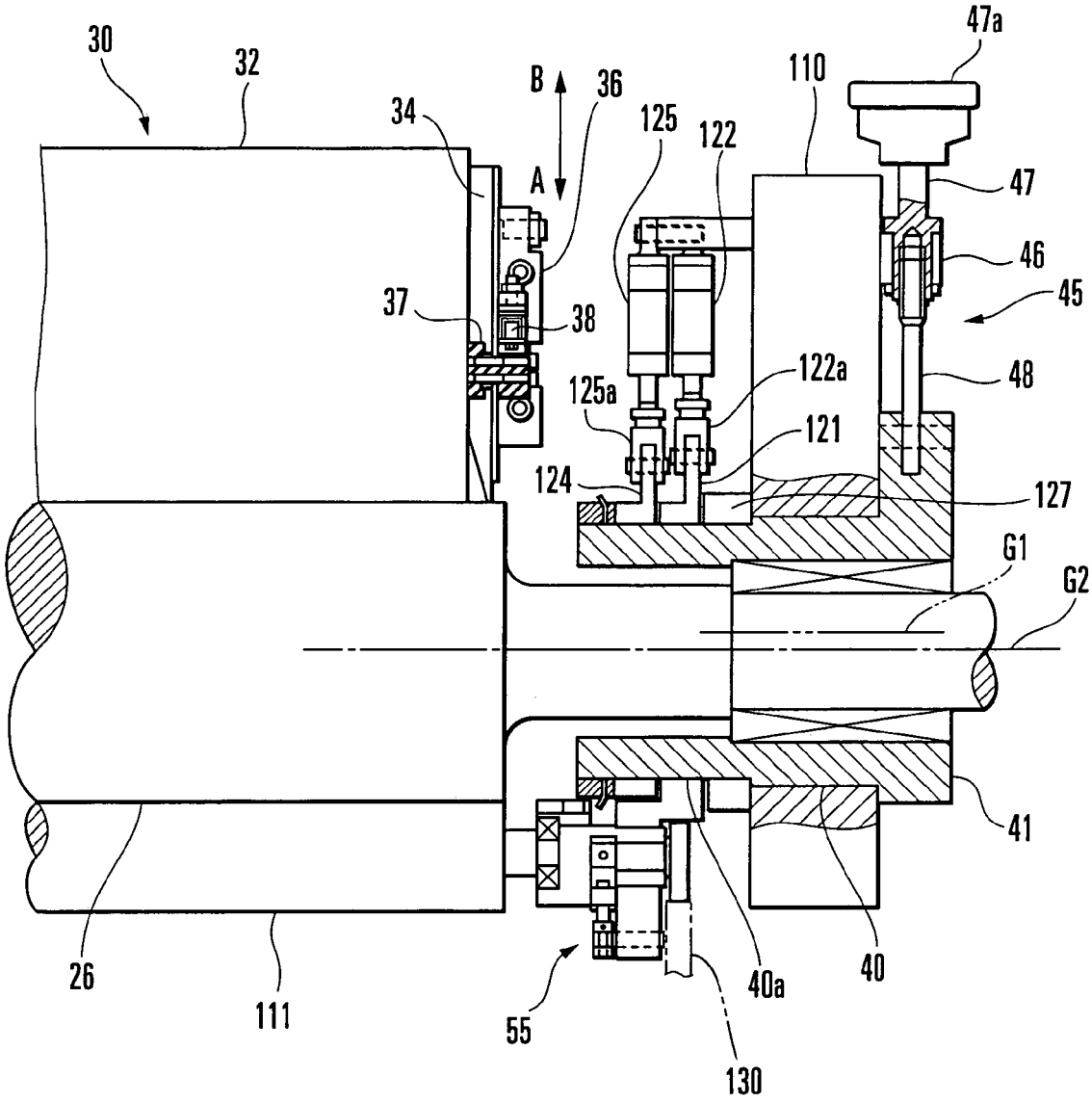
FIG. 7 is a partially sectional plan view showing the main part of the ink fountain device shown in FIG. 6.

The second embodiment of the present invention will be described with reference to FIGS. 5 to 7. In FIGS. 5 to 7, the same or identical elements as those of the first embodiment shown in FIGS. 1 to 4 described above are denoted by the same reference numerals, and a detailed description thereof will be omitted when appropriate.

The second embodiment is different from the first embodiment in the different cylinder array of three inking devices 117 among four inking devices which supply ink to a triple-diameter ink collecting cylinder 115. More specifically, as shown in FIG. 6, each inking device 117 comprises a fountain roller 26, a pair of form rollers 111 and 112 (second rotary body in claim 4) which come into contact with the fountain roller 26, a chablon roller 16 (first rotary body in claim 4) serving as the third rotary body which is in contact with the form rollers 111 and 112, and an oscillating roller 114 which comes into contact with the fountain roller 26.

A bracket 121 is axially supported by a small-diameter portion 40*a* of an eccentric bearing 40 about an axis G2 of the fountain roller 26 as a rotation center. The bracket 121 has an arm 121*a* and projection 121*b* at its peripheral portion. The arm 121*a* rotatably supports the form roller 111 through a nip pressure adjusting device 55. A rod 122*a* of an air cylinder 122 (second biasing means in claim 4) with a cylinder end pivotally supported by a frame 110 is pivotally mounted on the projection 121*b*. The form roller 111 is biased by the forward (a direction to rotate the bracket 121 clockwise) biasing force of the rod 122*a* of the air cylinder 122 to come into contact with the chablon roller 16.

As shown in FIG. 7, a bracket 124 is axially supported by the small-diameter portion 40*a* of the eccentric bearing 40 about the axis G2 of the fountain roller 26 as a rotation center. The bracket 124 has an arm 124*a* and a projection (not shown) at its peripheral portion. The arm 124*a* rotatably supports the form roller 112. A rod 125*a* of an air cylinder 125 (second biasing means in claim 4) with a cylinder end pivotally supported by the frame 110 is pivotally mounted on the projection of the bracket 124. The form roller 112 is biased by the backward (a direction to rotate the bracket 121 counterclockwise) biasing force of the rod 125*a* of the air cylinder 125 to come into contact with the chablon roller 16.

A bracket 127 is axially supported by the small-diameter portion 40*a* of the eccentric bearing 40 about the axis G2 of the fountain roller 26 as a rotation center. As shown in FIG. 6, the bracket 127 has an arm 127*a*, which rotatably supports the oscillating roller 114 (rotary body in claim 6), at its peripheral portion. A pair of pins 128 (guide members) which define the moving direction of the oscillating roller 114 extend upright on the frame 110 to clamp the arm 127*a* of the bracket 127.

The chablon roller 16 is provided with cams 130 and 133 which come into contact with cams 131 and 134 of the form rollers 111 and 112. The cam 130 forms a cam device 132 which maintains the nip pressure between the chablon roller 16 and form roller 111 constant when the eccentric bearing 40 is pivoted by the fountain roller moving device 45. The cam 133 forms a cam device 135 which maintains the nip pressure between the chablon roller 16 and form roller 112 constant when the eccentric bearing 40 is pivoted by the fountain roller moving device 45.

In this arrangement, in order to adjust the clearances between the outer surface of the fountain roller 26 and the distal ends of blades 33 at once, a driving shaft 47 is pivoted by a handle 47*a* clockwise or counterclockwise in the same manner as in the first embodiment. The eccentric bearing 40 pivots clockwise or counterclockwise through the driving shaft 47 and a stretchable shaft 48, to move the fountain roller 26 in the direction of an arrow A or B. At this time, the form rollers 111 and 112 and oscillating roller 114 are rotatably supported by the brackets 121, 124, and 127 which are pivotally supported about the axis G2 of the fountain roller 26 as pivot centers. Thus, despite the movement of the fountain roller 26 in the direction of the arrow A, the nip pressure between the form rollers 111 and 112 and oscillating roller 114 and the fountain roller 26 is maintained constant.

The form rollers 111 and 112 are biased by the biasing force of the air cylinder 122 toward the chablon roller 16. The cam devices 132 and 135 are provided which maintain the nip pressure between the form rollers 111 and 112 and the chablon roller 16 constant. When the fountain roller 26 moves in the direction of the arrow A, the form rollers 111 and 112 move against the biasing force of the air cylinder 122, and the nip pressure between the form rollers 111 and 112 and the chablon rollers 16 is always maintained constant.

Figure 8:
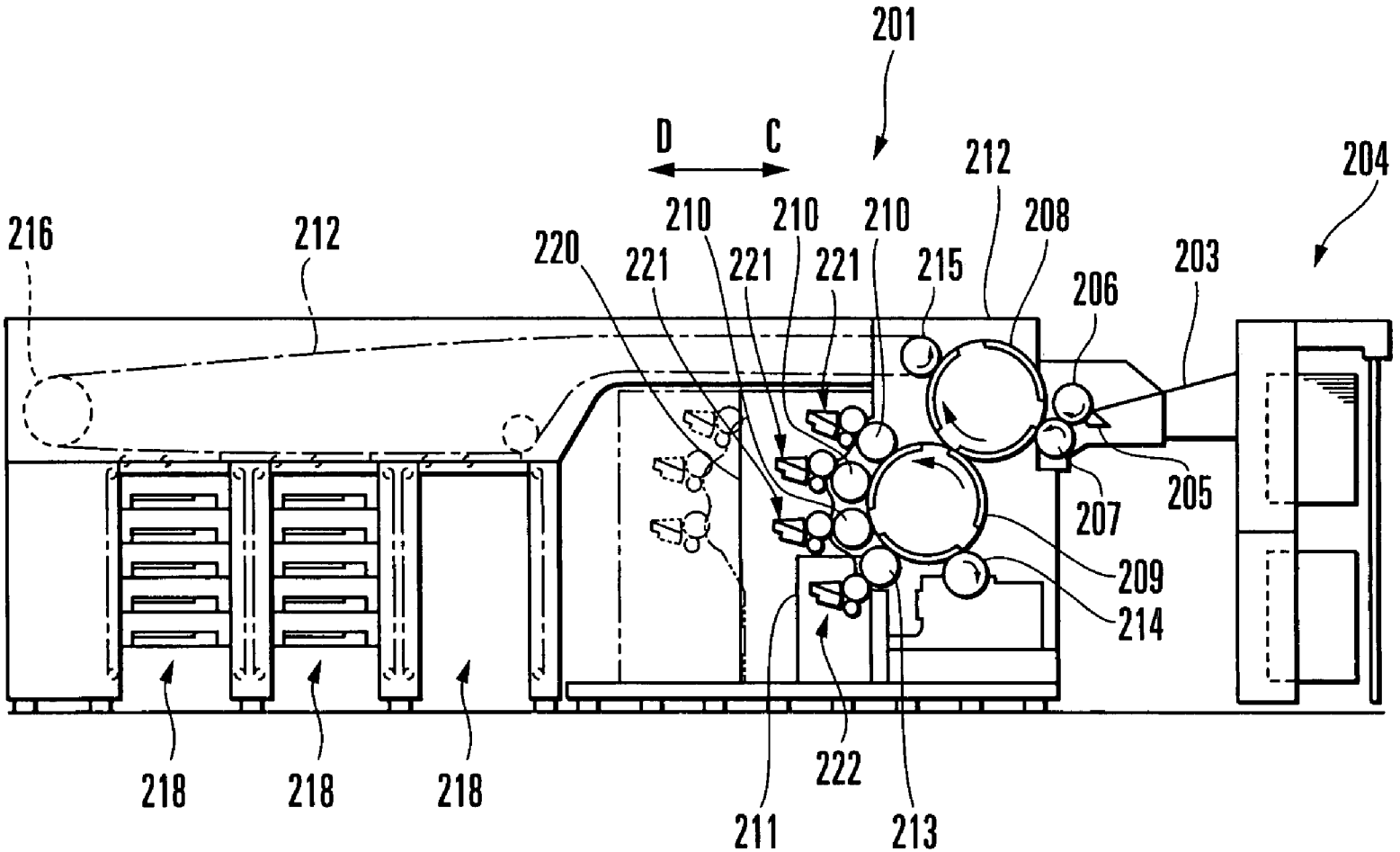
FIG. 8 is a side view showing the schematic arrangement of an intaglio printing press to which an ink fountain device according to the third embodiment of the present invention is applied.
Figure 9:
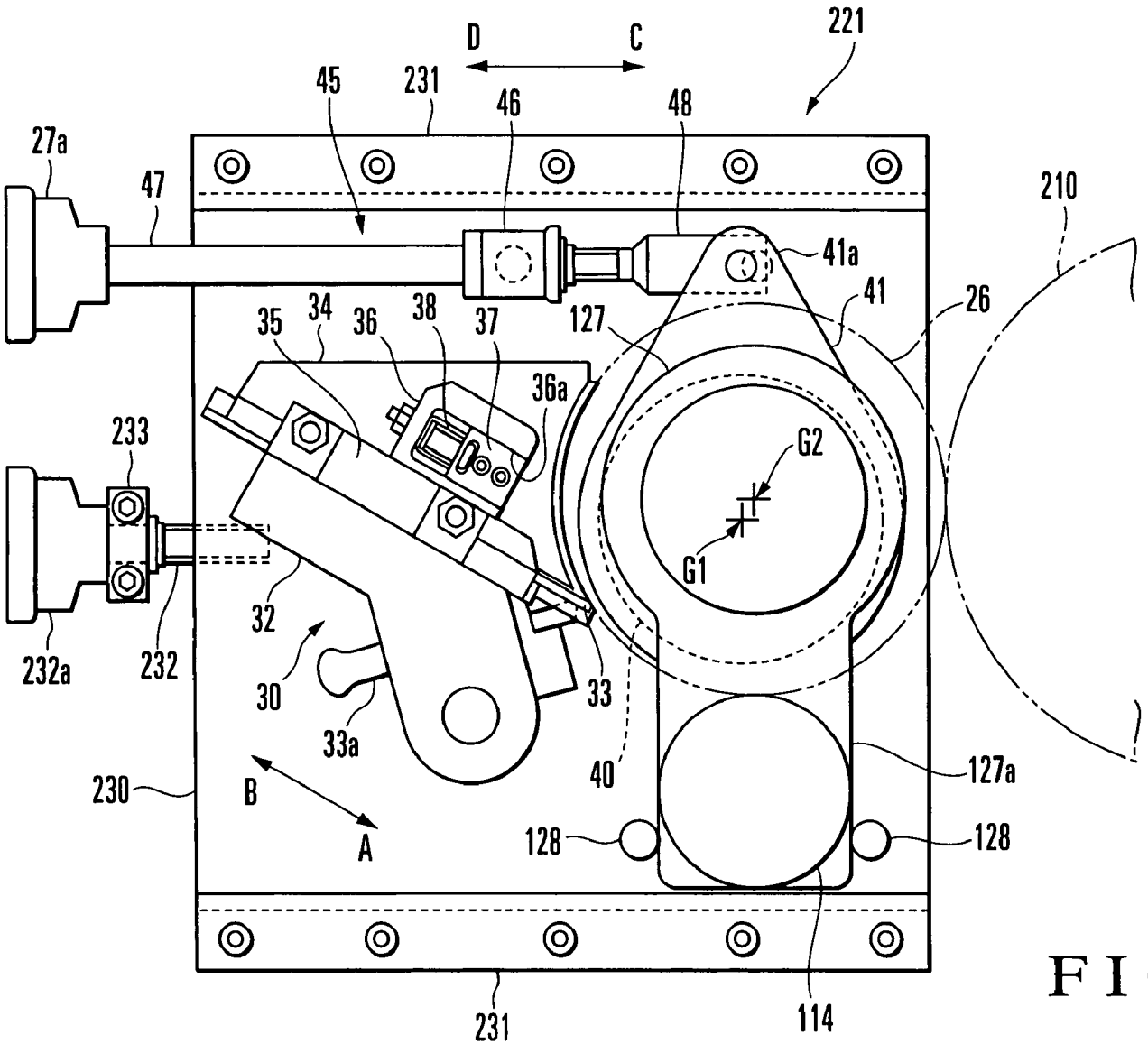
FIG. 9 is a side view showing the main part of the ink fountain device shown in FIG. 8.

An ink fountain device according to the third embodiment of the present invention will be described with reference to FIGS. 8 and 9. Referring to FIG. 8, an intaglio printing press 201 comprises a feed device 204 which feeds stacked sheets one by one to a feedboard 203. The sheet conveyed from the feed device 204 onto the feedboard 203 is registered in the circumferential direction and widthwise direction, and is then transferred to a transfer cylinder 206 by a swing arm shaft pregripper 205.

The sheet transferred to the transfer cylinder 206 is gripping-changed to a transfer cylinder 207 and then conveyed as it is gripping-changed to the grippers of a triple-diameter impression cylinder 20. The outer surface of a triple-diameter intaglio cylinder 209 which opposes the impression cylinder 208 is in contact with three chablon rollers 210 and a wiping roller 214. A first subframe 211 which is supported to be movable in a sheet convey direction (directions of arrows C and D) with respect to a main frame 212 supports a chablon roller 213. When the first subframe 211 moves in the direction of the arrow C or D, the chablon roller 213 moves toward or away from the outer surface of the intaglio cylinder 209.

A delivery chain 217 is looped between a sprocket (not shown) arranged coaxially with a delivery cylinder 215 which is in contact with the impression cylinder 208 and a sprocket 216 arranged on the rear side of the printing press 201. The sheet gripped by the delivery pawls of the delivery chain 217 drops onto one delivery device 218 and is stacked there. A second subframe 220 which is supported to be movable in the directions of the arrows C and D with respect to the main frame 212 is provided with three ink fountain devices 221 which supply ink to the three chablon rollers 210. The first subframe 211 is provided with an ink fountain device 222 which supplies ink to the chablon roller 213.

In this arrangement, the sheet which is fed from the feed device 204 onto the feedboard 203 is transferred to the transfer cylinder 206 by the swing arm shaft pregripper 205 and then to the impression cylinder 208 through the transfer cylinder 207. The ink which is supplied from the ink fountain devices 221 and 222 to the intaglio cylinder 209 through the chablon rollers 210 and 213 is get rid of excessive ink by the wiping roller 214, and is transferred onto the sheet which is conveyed by the impression cylinder 208. The printed sheet is transferred from the impression cylinder 208 to the delivery cylinder 215, gripping-changed to the delivery pawls of the delivery chain 217, conveyed as the delivery chain 217 travels, and delivered onto one delivery device 218.

The fountain device 221 will be described with reference to FIG. 9. In FIG. 9, the same or identical members as those described above with reference to FIGS. 1 to 7 are denoted by the same reference numerals, and a detailed description thereof will be omitted when appropriate. In the second embodiment, a fountain roller 26, ink fountain 30, and fountain roller moving device 45 are supported by movable frames 230. The movable frames 230 are supported to be movable in the directions of the arrows C and D with respect to the second subframe 220.

More specifically, a pair of guide members 231 which extend in the directions of the arrows C and D and vertically oppose each other are attached to the second subframe 220 (FIG. 8). The pair of guide members 231 support the movable frames 230 to be movable in the directions of the arrows C and D. The pair of movable frame 230 are spaced apart from each other by a predetermined gap in the axial direction of the fountain roller 26 (one movable frame is not shown). The ink fountain 30 is supported between the pair of movable frames 230, the fountain roller 26 is rotatably supported through eccentric bearings 40, and the fountain roller moving device 45 is supported through a support member 46.

A screw shaft 232 with one end side provided with a handle 232*a* (frame moving means) is rotatably supported by the second subframe 220 through a support member 233 such that its movement in the axial direction is regulated. The other end side (distal end side) of the screw shaft 232 threadably engages with the screw portion of the movable frame 230. When the screw shaft 232 is pivoted by the handle 232*a*, the movable frame 230 moves in the direction of the arrow C or D, to move the fountain roller 26 toward or away from the outer surface of the chablon roller 210.

In this arrangement, in order to adjust the clearances between the outer surface of the fountain roller 26 and the distal ends of blades 33 at once, a driving shaft 47 is pivoted by a handle 47*a* clockwise or counterclockwise in the same manner as in the first and second embodiments. The eccentric bearing 40 pivots through the driving shaft 47 and a stretchable shaft 48 to move the fountain roller 26 in the direction of an arrow A or B. Simultaneously, the screw shaft 232 is pivoted by the handle 232*a* in order to cancel the movement of the fountain roller 26 in the direction of the arrow B or A. This moves the movable frame 230 and fountain roller 26 in the direction of an arrow D, to maintain the nip pressure of the fountain roller 26 with respect to the chablon roller 210 constant.

In the respective embodiments described above, the pivot center G1 of the eccentric bearing 40 is set to be located under the pivot center G2 of the fountain roller 26, as indicated by a solid line in FIG. 4. Alternatively, the position of the pivot center G1 may be set above the pivot center G2 of the fountain roller 26, as indicated by an alternate long and two short dashed line. It suffices as far as the direction of the line L that connects the pivot center G1 of the eccentric bearing 40 and the axis G2 of the fountain roller 26 is substantially perpendicular to the moving direction (direction of the arrow A) of the ink dam 34.

Either one of the cam surface 41*c* and cam 56 can form a cam follower. Similarly, either one of the cams 130 and 131, and either one of the cams 133 and 134 can form cam followers, respectively. The clearances formed between the distal ends of the blades 33 and the outer surface of the fountain roller 26 are adjusted by the blades 33 and adjustment screws 33*a*. Alternatively, the clearances can be adjusted by a plurality of fountain keys that are supported by the blades 33 to be movable toward or away from the outer surface of the fountain roller 26. The driving shaft 47 and screw shaft 232 are operated manually. Alternatively, the driving shaft 47 and screw shaft 232 can be connected to, e.g., motors, and can be adjusted automatically. In this case, the motors may be controlled in accordance with the speed of the printing machine, so that the entire operation is automated.

As has been described above, according to the present invention, the eccentric bearing is pivoted by the fountain roller moving means, so the clearances between the fountain roller and bottom plates can be adjusted at once by the same amount. Thus, the quantity of ink to be supplied from the ink fountain to the fountain roller can be adjusted within a short period of time, and wasted paper can be decreased. The fountain roller is moved substantially in the same direction as the biasing direction of the ink dam. Therefore, despite the movement of the fountain roller, the ink dam can be held in tight contact with the fountain roller. Thus, ink leakage from the fountain roller can be regulated.

What is claimed is:

1. An ink fountain device comprising:

a fountain roller which is rotatably supported by an eccentric bearing;

a blade which is arranged close to said fountain roller and a distal end of which forms a clearance, with respect to an outer surface of said fountain roller, where ink is to be supplied;

a pair of ink dams which are arranged to be substantially perpendicular to said blade and oppose each other in an axial direction of said fountain roller, and are supported to be movable toward and away from said outer surface of said fountain roller;

first biasing means for biasing said ink dams to move toward said outer surface of said fountain roller; and fountain roller moving (displacing) means for pivoting said eccentric bearing so as to move said fountain roller, wherein said pair of ink dams are moved by a biasing force of said first biasing means in a direction substantially perpendicular to a line that connects an axis of said fountain roller and a pivot center of said eccentric bearing.

2. A device according to claim 1, further comprising:

a first rotary body which is supported rotatably;

a second rotary body which comes into contact with said fountain roller and said first rotary body;

a bracket which is pivotally supported coaxially with said first rotary body and rotatably supports said second rotary body;

second biasing means for biasing said second rotary body through said bracket to move toward said outer surface of said fountain roller; and cam means for maintaining a nip pressure between said fountain roller and said second rotary body constant.

3. A device according to claim 2, wherein said first rotary body comprises an oscillating roller which is arranged in a printing unit and supplies the ink to an ink roller group, and said second rotary body comprises an ink ductor roller which is arranged in said printing unit and supplies the ink from said fountain roller to said oscillating roller.

4. A device according to claim 1, further comprising:

a first rotary body which is supported rotatably;

at least one second rotary body which comes into contact with said fountain roller and said first rotary body;

a bracket which is pivotally supported about the axis of said fountain roller as a rotation center and rotatably supports said second rotary body;

second biasing means for biasing said second rotary body to move toward an outer surface of said first rotary body; and cam means for maintaining a nip pressure between said first rotary body and said second rotary body constant.

5. A device according to claim 4, wherein said first rotary body comprises a chablon roller which is arranged in a printing unit, and said second rotary body comprises a foam roller which is arranged in said printing unit and supplies the ink from said fountain roller to said chablon roller.

6. A device according to claim 1, further comprising:

a rotary body which comes into contact with said fountain roller;

a bracket which is pivotally supported about the axis of said fountain roller as a rotation center and rotatably supports said rotary body; and a guide member which regulates a moving direction of said rotary body.

7. A device according to claim 6, wherein said rotary body comprises an oscillating roller which is arranged in a printing unit and distributes the ink on said fountain roller.

8. A device according to claim 1, further comprising:

a movable frame which supports said fountain roller, said blade, said pair of ink dams, said first biasing means, and said fountain roller moving (displacing) means to be movable toward and away from an outer surface of a rotary body with which said outer surface of said fountain roller comes into contact; and frame moving means for moving said movable frame.

9. A device according to claim 1, wherein said eccentric bearing includes a flange which is exposed outside, and said fountain roller moving means comprises a driving mechanism with an acting end pivotally mounted on said flange, said acting end being reciprocated when a manipulation end is pivoted, to pivot said flange.

10. A device according to claim 9, wherein said driving mechanism comprises a driving shaft which pivots when said manipulation end is pivoted, and a stretchable shaft which is screw-coupled to said driving shaft and is reciprocated interlocked with pivot motion of said driving shaft, to pivot said flange.

11. A device according to claim 1, further comprising an ink dam moving mechanism which supports said ink dams to be movable toward said outer surface of said fountain roller, wherein said ink dam moving mechanism comprises a fountain main body which supports said blade and said ink dams, a pair of guide plates which extend upright from two ends of said fountain main body in an axial direction of said fountain roller, a guide groove which is formed in each of said pair of guide plates, a moving element which is attached to each of said ink dams and engages in said guide groove, and a compression coil spring serving as said first biasing means which is elastically mounted between a corresponding one of said guide plates and said moving element, for biasing a corresponding one of said ink dams to move toward said outer surface of said fountain roller with a spring force.

* * * * *